US006686944B1

(12) United States Patent
Huang et al.

(10) Patent No.: US 6,686,944 B1
(45) Date of Patent: Feb. 3, 2004

(54) METHOD FOR RECOGNIZING A COLOR OF A PRINTING RIBBON AND RIBBON FORMAT THEREOF

(75) Inventors: Kuan-Chih Huang, Taipei Hsien (TW); Sheng-Chih Lin, Taipei (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 0 days.

(21) Appl. No.: 10/065,912

(22) Filed: Nov. 28, 2002

(51) Int. Cl.[7] ..... B41J 35/18
(52) U.S. Cl. ..... 347/178
(58) Field of Search ..... 347/178, 217; 400/120.02, 224.2

(56) References Cited

U.S. PATENT DOCUMENTS 6,071,024 A * 6/2000 Chi-Ming et al. ..... 400/120.02
6,396,526 B1 * 5/2002 Sung et al. ..... 347/178

FOREIGN PATENT DOCUMENTS

JP 64-87376 * 3/1989 ..... B41J/35/16

* cited by examiner

*Primary Examiner*—Huan Tran
(74) *Attorney, Agent, or Firm*—Winston Hsu

(57) ABSTRACT

A method for recognizing a color of a printing ribbon includes providing a printing ribbon having a repeated sequence of dyed and undyed regions such that output of a photosensor sensing the ribbon is a low or high level based on a threshold. The method includes illuminating a sensing area of the ribbon, moving the ribbon relative to the sensing area, measuring output of the photosensor over time as the ribbon moves, correlating output of the photosensor to the repeated sequence as the ribbon moves to determine the color of the ribbon under the print head, and setting operational parameters of the printer and print head according to the color of the ribbon under the print head. The repeated sequence is unprintable black dye, yellow dye with undyed ribbon, magenta dye, undyed ribbon, cyan dye, and transparent overcoating with undyed ribbon.

15 Claims, 9 Drawing Sheets

METHOD FOR RECOGNIZING A COLOR OF A PRINTING RIBBON AND RIBBON FORMAT THEREOF

BACKGROUND OF INVENTION

1. Field of the Invention

The present invention relates to digital printer, and more specifically to a digital printer that utilizes a dye ribbon.

2. Description of the Prior Art

Digital printers are used in computer systems to print digital images. One type of printer uses a print head to heat a dye ribbon to transfer dye of different colors to a print medium. The dye ribbon comprises dyed regions colors that can be proportioned to approximate true color, and usually has a transparent overcoating region as well. Currently, this type of printer is commonly used to print digital photographs.

Consider a thermal printer 20 as shown in FIG. 1. The thermal printer 20 includes a housing 22, a thermal print head 24 mounted on a track 26 that is attached to the housing 22, and a removable ribbon cassette 28 installed in the housing and having a spooled dye ribbon 30. The printer 20 further includes motors (not shown and a control circuit (ref. 38 of FIG. 2) that drive the print head 24 and ribbon cassette 28 to print dye onto a print medium (not shown) such as a piece of paper.

Please refer to FIG. 2 showing a cross-sectional view of the printer 20 cut along a section line 2—2 of FIG. 1. In FIG. 2 some components of FIG. 1 are omitted for clarity. The printer 20 further comprises a light source (such as an LED) 32 and a photosensor 34. The light source 32 emits light to the dye ribbon 30. Where the light passes through the ribbon 30 the light can be detected by the photosensor 34. A specific arrangement of the light source 32 and photosensor 34 establishes a specific sensing area 36 on the ribbon 30. A controller 38 controls the operation of the printer 20 by controlling the print head 24, ribbon cassette 28, light source 32, and photosensor 34. As the controller 38 controls the ribbon 30 to advance so that the print head 24 can print different colors to the print medium, a color of the ribbon 30 in the sensing area 36 changes.

Please refer to FIG. 3 showing the dye ribbon 30 removed from the ribbon cassette 28. The ribbon 30 comprises regions of printing dye separated by strips of unprintable black dye. In FIG. 3 printing dye is identified as Y for yellow, M for magenta, C for cyan, and O for transparent overcoating, while the unprintable black strips are identified as B. The sensing area 36 and print head 24 are separated by a predetermined distance. As the ribbon 30 moves relative to the sensing area 36, the photosensor 34 detects the black dye regions B and triggers the printer to set operational parameters for the next color of dye on the ribbon 30.

For example, suppose the ribbon 30 as illustrated in FIG. 3 is moving to the right, the photosensor 34 and print head 24 are stationary, and the printer 20 has just completed printing magenta dye to the print medium. The photosensor 34 detects the black strip between the yellow and magenta dye regions and automatically configures operational parameters of the print head 24 for printing yellow. That is, the black strips trigger the printer to prepare for the next color in the predetermined color sequence of the ribbon 30.

This triggering process is readily apparent in the signal diagram of FIG. 4 The signal diagram of FIG. 4 shows a plot of signal output of the photosensor 34 against a distance X along the length of the ribbon 30. The photosensor 34 is configured such that it has a low output when detecting the unprintable black dye strips and a high output when detecting any colored printing dye region.

There are several disadvantages of the prior art printer 20. These include the expense of disposing a plurality of unprintable black dye regions that are exclusively used for detection and the added length of ribbon 30 needed to accommodate the black dye regions.

SUMMARY OF INVENTION

It is therefore a primary objective of the claimed invention to provide a method for recognizing a color of a printing ribbon and a ribbon thereof to solve the problems of the prior art.

Briefly summarized, the claimed invention method includes providing a printing ribbon having a repeated sequence of dyed and undyed regions such that output of a photosensor sensing the ribbon is a low or high level based on a threshold. The repeated sequence is a short low level region, a first long high level region, a first long low level region, a short high level region, a second long low level region, and a second long high level region. The method includes illuminating a sensing area of the ribbon, moving the ribbon relative to the sensing area, measuring output of the photosensor over time as the ribbon moves, correlating output of the photosensor to the repeated sequence as the ribbon moves to determine the color of the ribbon under the print head, and setting operational parameters of the printer and print head according to the color of the ribbon under the print head.

According to an embodiment of the claimed invention the short low level region comprises black dye, the first long high level region comprises yellow dye and undyed ribbon, the first long low level region comprises magenta dye, the short high level region comprises undyed ribbon, the second long low level region comprises cyan dye, and the second long high level region comprises transparent overcoating and undyed ribbon.

It is an advantage of the claimed invention that the dye regions themselves are used to trigger the photosensor to allow to printer to set operational parameters for the print head and the color of dye ribbon.

It is a further advantage that no exclusive unprintable black dye regions are required to trigger the photosensor thus saving the associated manufacturing cost and time.

These and other objectives of the claimed invention will no doubt become obvious to those of ordinary skill in the art after reading the following detailed description of the preferred embodiment that is illustrated in the various figures and drawings.

DETAILED DESCRIPTION

Figure 5:
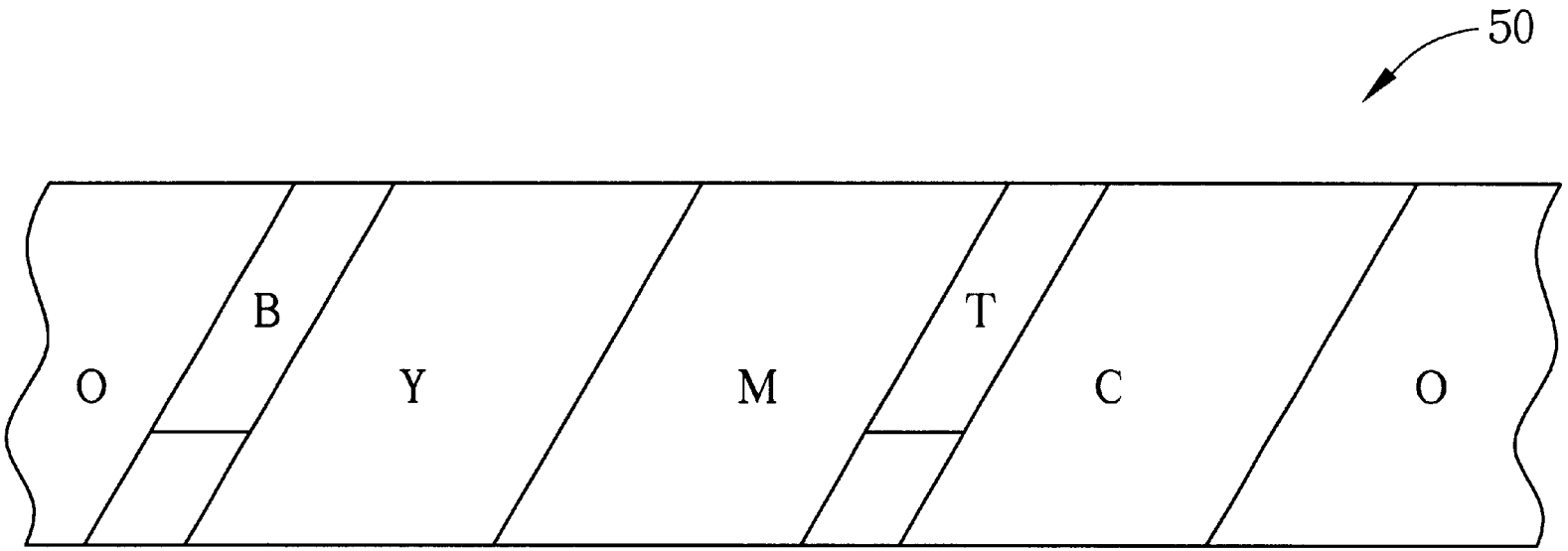
FIG. 5 is a schematic diagram of a printing ribbon according to a first embodiment of the present invention.

Please refer to FIG. 5 showing a printing ribbon according to a first embodiment of the present invention. The ribbon 50 is used in a thermal printer such as the thermal printer 20 and can accordingly be spooled in the ribbon cassette 28. The ribbon 50 is used in the printer 20 in much the same way as the ribbon 30 is as previously described. The ribbon 50 is made of a thin polymer film on which printing dye is disposed in a regular pattern. In FIG. 5 regions of printing dye are designated by Y for yellow, M for magenta, C for cyan, and O for transparent overcoating. In addition, the ribbon 50 has undyed regions of film designated by T and shortened regions of unprintable black dye indicated by B. The ribbon 50 is substantially longer than it is wide and the illustrated sequence of colored dye, overcoating, undyed film, and permanent black ink is repeated along its length.

Figure 1:
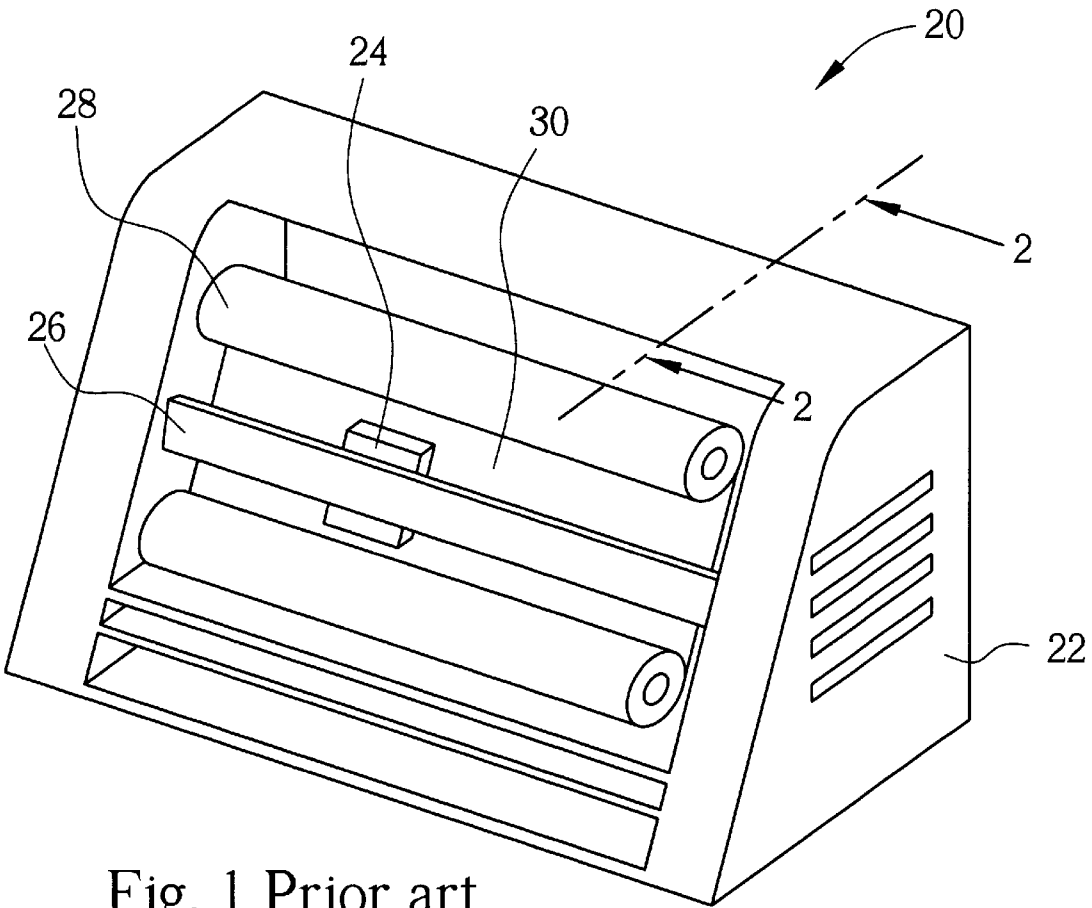
Fig. 1 Prior art
FIG. 1 is a perspective view of a thermal printer.
Figure 2:
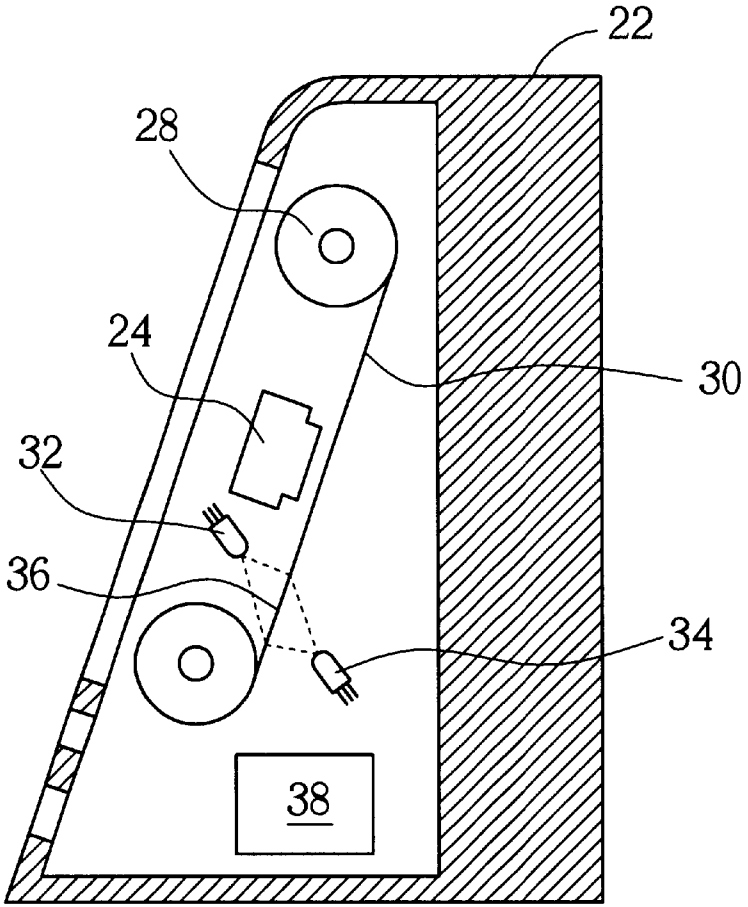
FIG. 2 is a cross-sectional view of the printer of FIG. 1 along a section line 2—2.
Figure 3:
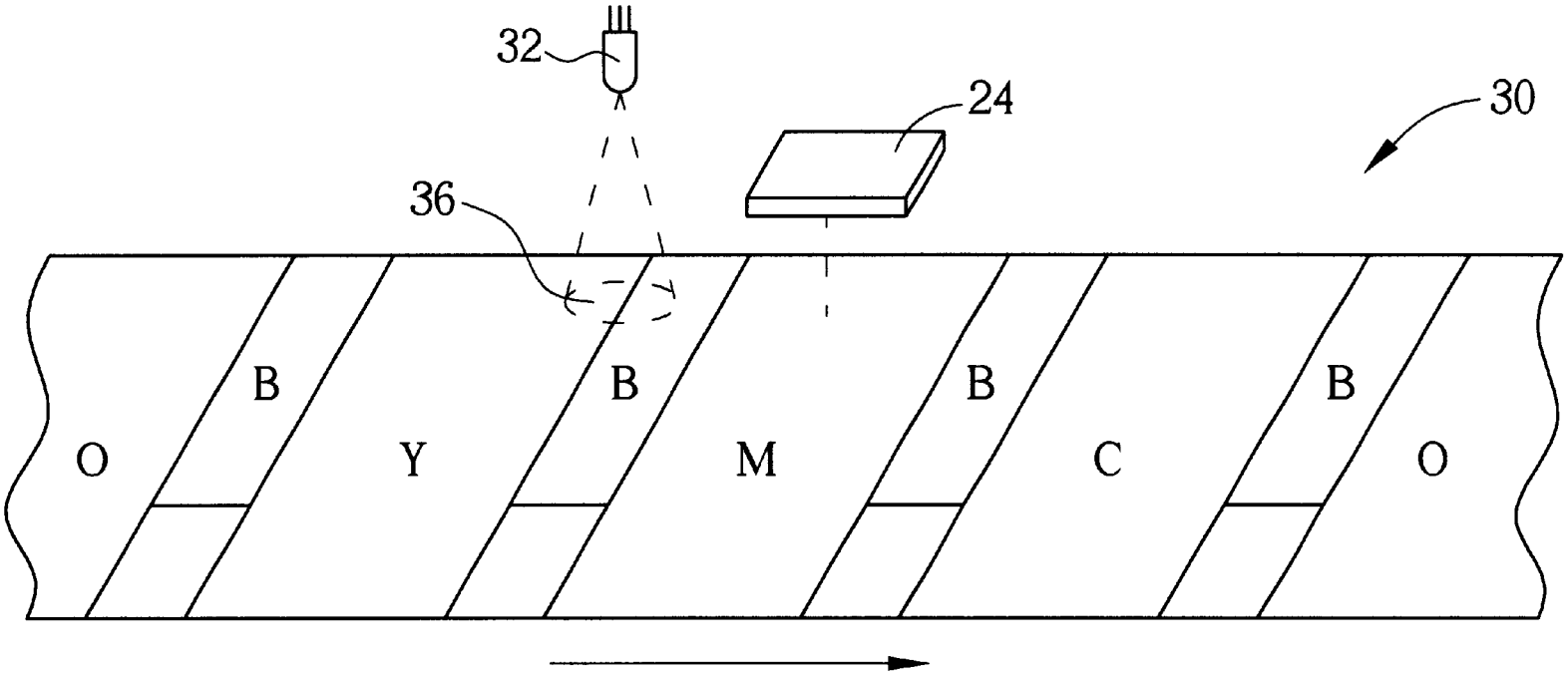
Fig. 3 Prior art
FIG. 3 is a schematic diagram of a printing ribbon according to the prior art.
Figure 4:
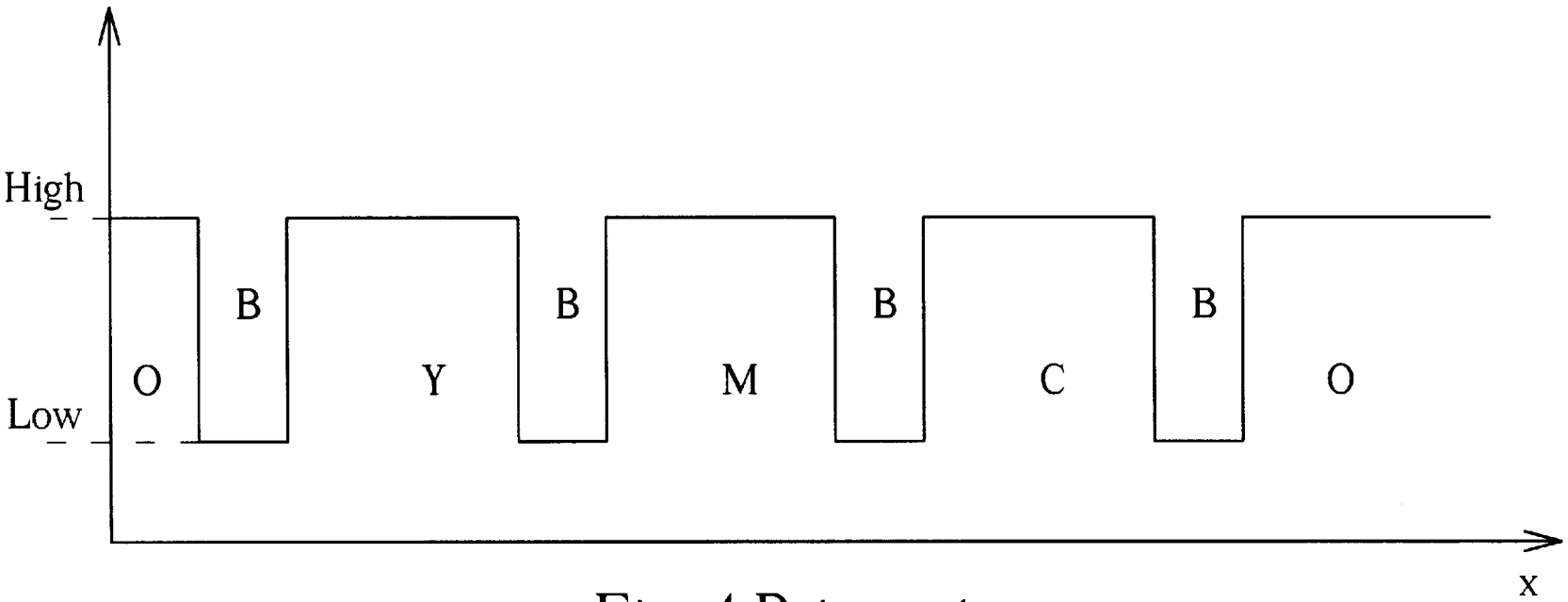
Fig. 4 Prior art
FIG. 4 is a signal diagram of output of the photosensor shown in FIG. 2.

The printer 20 shown in FIG. 2 is configured to use the ribbon 50 by programming logic of the controller 38 in accordance with the present invention method. In addition, the photosensor 34 of the printer 20, is configured to output a high signal when detecting lighter colors of the ribbon 50 such as yellow, undyed film, and transparent overcoating. The photosensor 34 is further configured to output a low signal when detecting darker colors of the ribbon 50 such as black, magenta, and cyan. The controller 38 is set read the output of the photosensor 34 and to measure a time that the output of the photosensor 34 remains at a substantially constant level as the ribbon 50 moves through the sensing area 36. As the time measured is related to the speed at which the ribbon 50 moves through the sensing area 36 and past the print head 24, the time measured thus corresponds to the position of the print head 24 along the length of the ribbon 50. Equivalently, the controller 38 could measure distance along the ribbon 50 rather than time and printing speed. In this way, the controller 38 and photosensor 34 can be used to determine a series of pulses relating to the dyed and undyed regions of the ribbon 50.

Figure 6:
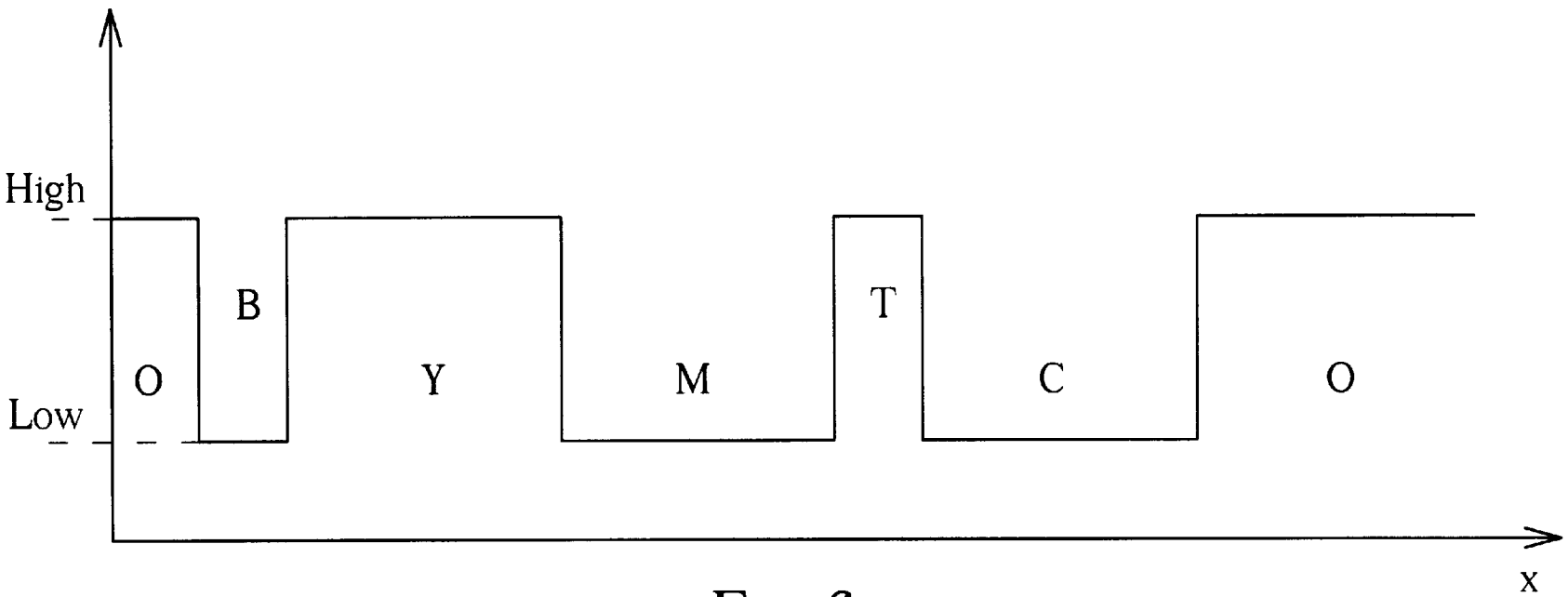
FIG. 6 is a signal diagram for the printing ribbon shown in FIG. 5

The high/low output of the photosensor 34 corresponding to the ribbon 50 is shown in FIG. 6. The high/low output is plotted with respect to a distance X along the length of the ribbon 50. Note that lengths of high and low pulses shown in FIG. 6 correspond to lengths of the dye regions of the ribbon 50, and the lengths of the pulses are proportional to a printing speed of the printer 20. The high/low and long/short levels of the output of the photosensor 34 can be established in the controller 38 by using thresholds. Logic required by the printer 20 to detect the regions of the ribbon 50 is stored in the controller 38. Supposing that the ribbon 50 moves to the left, a short low pulse indicates to the printer 20 that a black region B has been detected a yellow region Y is available for printing. A short high pulse indicates that an undyed region T has been detected and that a cyan region C is queued. Other regions are detected in a similar way. For instance, the printer 20 detects a magenta region M by a short low pulse followed by a long high pulse. As the ribbon 50 moves relative to the print head 24 and taking into account that the sensing area 36 and the print head 24 are separated by the predetermined distance, the controller 38 compares the high/low output of the photosensor 34 to determine the color of a dye region of the ribbon 50 under the print head 24.

All of the regions of the ribbon 50 can be uniquely detected by the printer 20 using one or two pulses regardless of the relative direction of motion of the ribbon 50 to the print head 24. As mentioned when the ribbon 50 moves to the left, yellow Y and cyan C regions require that only a short low or high pulse be respectively detected. Other regions such as magenta M, undyed film T, overcoating O, and black B require two pulses for identification. As the printer 20 is set with a current printing color as it prints, detecting two pulses is essentially the same as detecting one pulse. Moreover, an unprintable black region B is typically the first region on the entire length of the ribbon so that a yellow region Y is queued immediately upon the ribbon 50 being installed in the printer 20. With this, the printer 20 needs only to detect changes in level of the photosensor 34 output after a yellow region Y has be determined.

Figure 7:
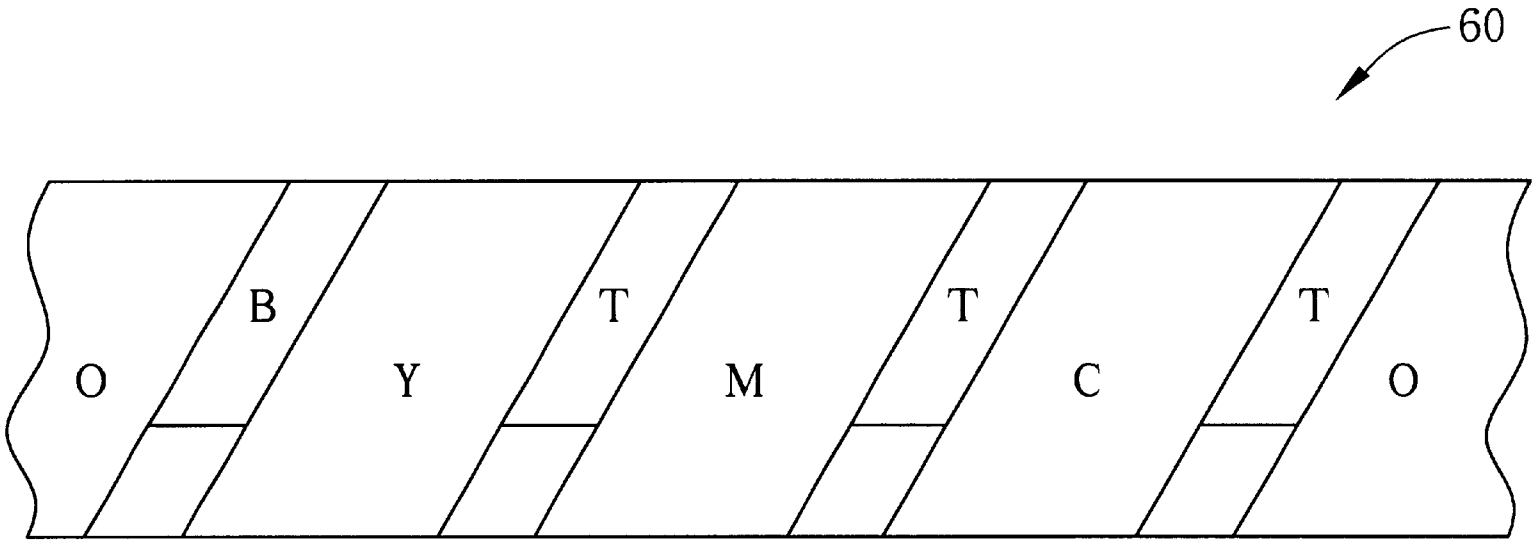
FIG. 7 is a schematic diagram of a printing ribbon according to a second embodiment of the present invention.
Figure 8:
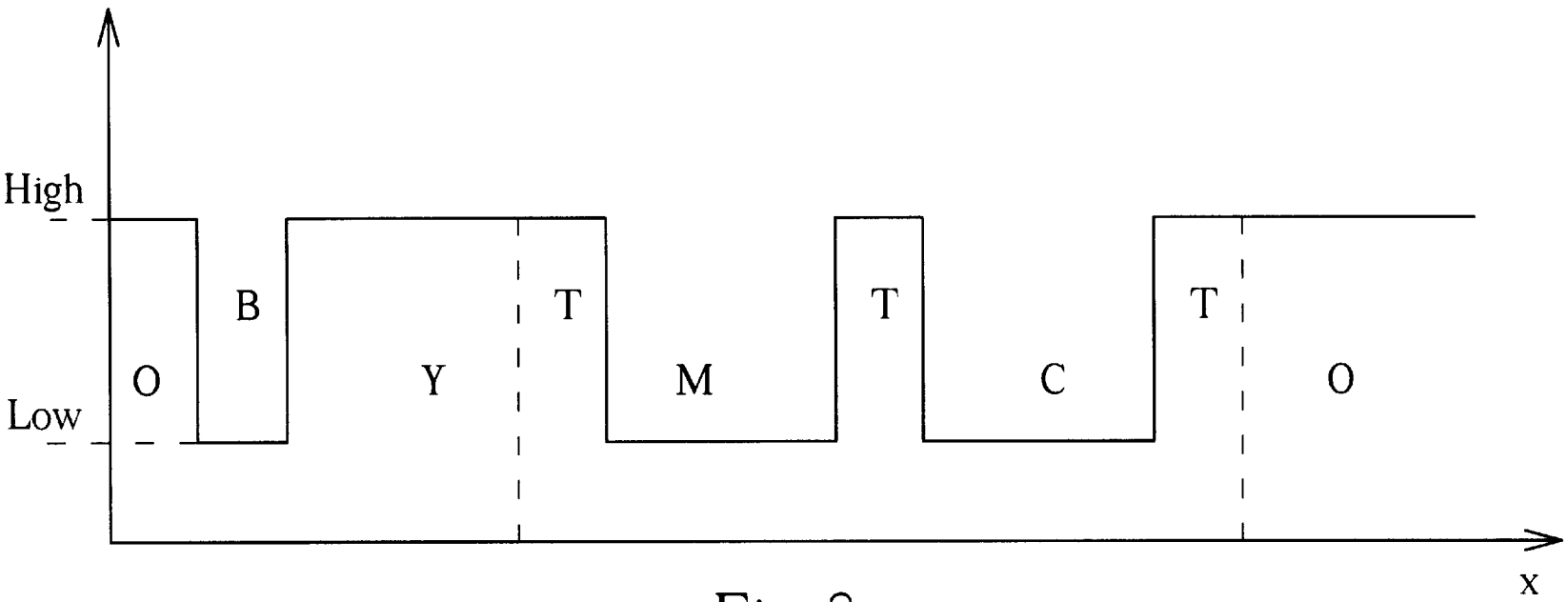
FIG. 8 is a signal diagram for the printing ribbon shown in FIG. 7

A printing ribbon 60 as shown in FIG. 7 illustrates a second embodiment of the present invention. The ribbon 60 is similar to the ribbon 50 except that black regions B of unprintable dye span the width of the ribbon 60, and undyed transparent regions T of ribbon film separate larger printing dye regions. As can be seen in photosensor 34 output of FIG. 8, the additional undyed regions T do not substantially change the output from that of FIG. 6. While the high levels of yellow Y and overcoating O regions are extended, a long/short threshold or a detected level change can still be used to effectively identify the colored dye regions. The second embodiment may be desirable for ribbon manufacturing concerns.

Figure 9:
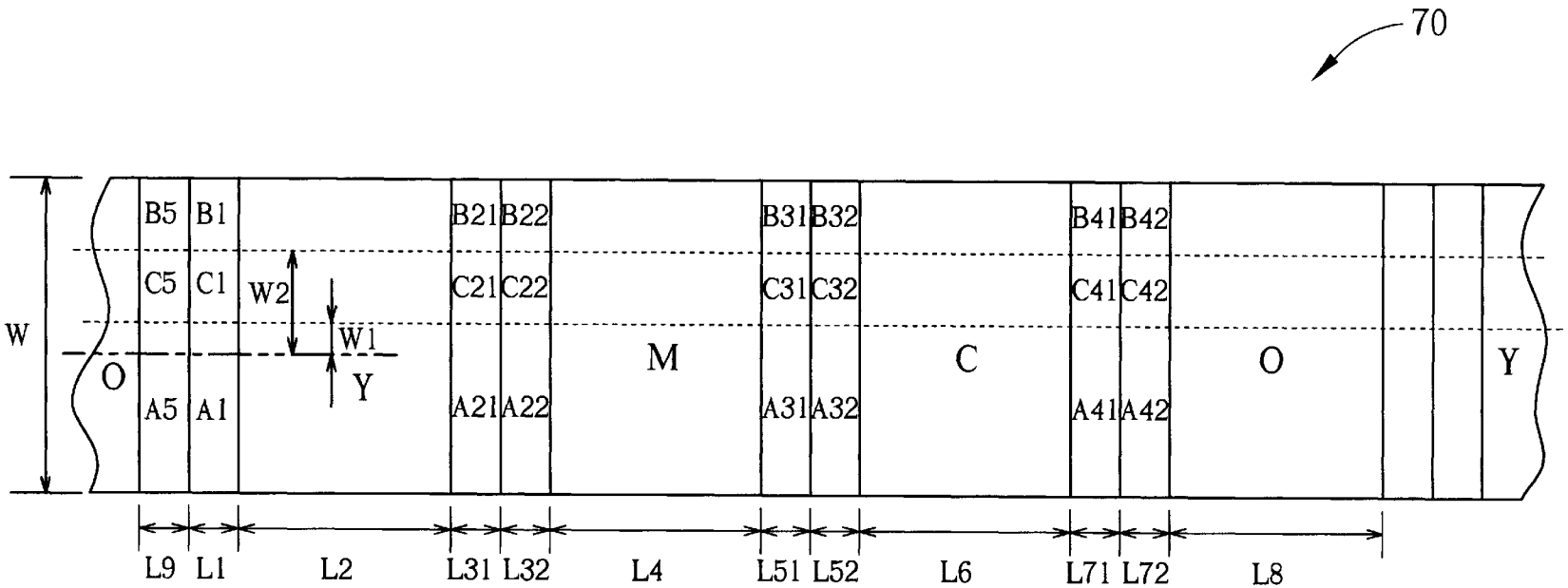
FIG. 9 is a dimensional diagram of the printing ribbon shown in FIG. 7.

An example of a printing ribbon 70 according to the second embodiment of the present invention is shown in FIG. 9. Regions of printing dye are identified by Y, M, C, and O as in FIG. 5 and FIG. 7. Dimensions and limitations of the ribbon 70 are based on a predetermined distance between the sensing area 36 and the print head 24 of 22 mm and are as follows:

All dimensions are millimeters (mm);

$0<=L1<30$, $L1+L2>177$;

$L31>=0$, $0<=L31+L32<30$, $L31+L32+L4>177$;

$L51>=1$, $1<=L51+L52<30$, $L51+L52+L6>177$;

$L71>=0$, $0<=L71+L72<=30$, $L71+L72+L8>177$;

$1<=L9<25$;

$W>=90$;

$0<=W1<=W/2$, $0<=W2<=W/2$, $W2\ W1>=1$;

Regions C1, C21, C31, C41, C42 must be regions of yellow, undyed film, or transparent overcoating (high level colors);

Regions C5 and C22 must be low level colors—regions comprising black, magenta, and/or cyan. Note that blends of black and magenta, magenta and cyan, black and cyan, or black, magenta, and cyan resulting in a low level color are acceptable. Furthermore, any pattern made with these colors is acceptable in these two areas (for example, C5 could have a magenta square with a black circle in the center);

Regions A1, A21, A22, A31, A32, A41, A42, AS, B1, B21, B22, B31, B32, B41, B42, B5, and C32 may be regions of any color and of any pattern of colors;

For both the first and second embodiments colors of the dye regions are only constrained to be cause the photosensor 34 output to be either a high or a low voltage or current level. For instance, a magenta region if necessary can replace the black unprintable dye region, or undyed regions may be coated with yellow printing dye. The specific color arrangement should work with design and manufacturing requirements.

In contrast to the prior art, the present invention printing dye regions are used to trigger a photosensor so that a printer can identify a color of a region of a printing ribbon and set corresponding operational parameters. The present invention accomplishes this with minimal redundant use of permanent black dye identification strips so as to reduce ribbon manufacturing time and cost.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for recognizing a color of a printing ribbon used in a printer, the method comprising:

providing a printing ribbon comprising colored dye disposed in regions arranged in a repeated sequence wherein light colors of dye and undyed ribbon cause a photosensor output to be a high level above a threshold and dark colors of dye cause the photosensor output to be a low level below the threshold; the repeated sequence of colored dye being a short dark region, a first long light region, a first long dark region, a short light region, a second long dark region, and second long light region; the ribbon capable of being moved relative to a print head so that the print head is capable of inducing the ribbon to transfer dye of a specific color onto a print medium;

illuminating a sensing area of the ribbon, the sensing area being adjacent to the photosensor and being a predetermined distance from the print head;

moving the ribbon relative to the sensing area;

measuring output of the photosensor over time as the ribbon moves;

correlating output of the photosensor to the repeated sequence as the ribbon moves to determine the color of the ribbon under the print head; and setting operational parameters of the printer and print head according to the color of the ribbon under the print head.

2. The method of claim 1 wherein the dark regions are of dye of colors black, magenta, and cyan and the light regions are of yellow dye, undyed ribbon, and transparent overcoating.

3. The method of claim 2 wherein the short dark region comprises black dye, the first long light region comprises yellow dye, the first long dark region comprises magenta dye, the short light region comprises undyed ribbon, the second long dark region comprises cyan dye, and the second long light region comprises transparent overcoating.

4. The method of claim 3 wherein the first long light region further comprises undyed ribbon and the second long light region further comprises undyed ribbon.

5. The method of claim 3 wherein the black dye is unprintable.

6. The method of claim 1 wherein the dark regions are of dye comprising a mix of colors black, magenta, and cyan having predetermined patterns; and the light regions comprise a mix of yellow dye, undyed ribbon, and transparent overcoating having other predetermined patterns.

7. The method of claim 1 wherein in a region of the ribbon moved through the sensing area, the short dark region and the first long dark region comprise a mix of colors black, magenta, and cyan having predetermined patterns; and in a region of the ribbon not moved through the sensing area, the short dark region, the first long light region, the short light region, and the second long light region comprise any color of any pattern.

8. The method of claim 1 wherein correlating the output of the photosensor to the repeated sequence comprises detecting the short dark region and the short light region as signal pulses to determine the color under the print head.

9. The method of claim 8 wherein correlating the output of the photosensor to the repeated sequence further comprises detecting transitions between the high and low levels to determine the color under the print head.

10. The method of claim 1 wherein the ribbon is a transparent polymer film having a length substantially longer than a width.

11. The method of claim 10 wherein the ribbon is spooled in a ribbon cassette.

12. The method of claim 1 wherein the dye is thermal transfer dye.

13. The method of claim 12 wherein the print head is a thermal print head, the method further comprising heating the ribbon with the print head to transfer dye onto the print medium.

14. The method of claim 1 wherein illuminating the sensing area is performed by a light emitting diode (LED).

15. A printer comprising a housing, a printing ribbon having a repeated sequence of colored printing dye spooled in a ribbon cassette installed in the housing, a print head moveably disposed in the housing for transferring dye on the ribbon to a print medium, a light source and photosensor for detecting the ribbon color, and a controller for controlling the relative position of the ribbon and the print head according to the method of claim 1.

* * * * *